US005593101A

United States Patent [19]

Varga

[11] Patent Number: 5,593,101

[45] Date of Patent: Jan. 14, 1997

[54] APPARATUS FOR AND METHOD OF CONTINUOUSLY SPOOLING A FILAMENT ON REELS WITH ACCESSIBLE LONG INSIDE ENDS

[75] Inventor: Joseph Varga, Woodbridge, Canada

[73] Assignee: Ceeco Machinery Manufacturing, Ltd., Concord, Canada

[21] Appl. No.: 394,794

[22] Filed: Feb. 27, 1995

[51] Int. Cl.[6] ..... B65H 67/044; B65H 54/00

[52] U.S. Cl. ..... 242/25 A; 242/18 A; 242/18 PW; 242/602.2

[58] Field of Search ..... 242/18 PW, 18 A, 242/25 A, 25 R, 602.1, 602.2

[56] References Cited

U.S. PATENT DOCUMENTS

| | | | |
|---|---|---|---|
| 2,763,442 | 9/1956 | Bruestle . | |
| 3,011,730 | 12/1961 | Martino . | |
| 3,082,967 | 3/1963 | Hyprath et al. . | |
| 3,086,721 | 4/1963 | Duff . | |
| 3,201,055 | 8/1965 | Guenther et al. | 242/25 R |
| 3,368,765 | 2/1968 | O'Grady . | |
| 3,620,482 | 11/1971 | Bravia . | |
| 3,621,190 | 11/1971 | Morikawa et al. . | |
| 3,625,448 | 12/1971 | Griffiths . | |
| 3,698,652 | 10/1972 | Morikawa et al. . | |
| 3,743,210 | 7/1973 | Hawley | 242/18 PW X |
| 3,761,030 | 9/1973 | Leinonen et al. . | |
| 3,831,870 | 8/1974 | Daniel | 242/25 A X |
| 3,831,871 | 8/1974 | Ikegami et al. . | |
| 3,845,913 | 11/1974 | Hagen . | |
| 4,015,785 | 4/1977 | Ikegami et al. | 242/25 A |
| 4,030,673 | 6/1977 | Veyrassat . | |
| 4,098,467 | 7/1978 | Engmann et al. . | |
| 4,111,376 | 9/1978 | Hoddinott et al. . | |
| 4,119,278 | 10/1978 | Draizen et al. . | |
| 4,157,792 | 6/1979 | Wyckhuys . | |
| 4,223,848 | 9/1980 | Brokke et al. . | |
| 4,292,144 | 9/1981 | Engman et al. . | |
| 4,369,928 | 1/1983 | Riekkinen et al. | 242/25 A |
| 4,438,886 | 3/1984 | Meisser et al. . | |
| 4,643,368 | 2/1987 | Hattersley, Jr. | 242/25 A |
| 4,687,148 | 8/1987 | Schuller et al. | 242/18 PW |
| 4,696,438 | 9/1987 | Myers | 242/18 PW X |
| 4,979,687 | 12/1990 | Birch | 242/25 A |

FOREIGN PATENT DOCUMENTS

| | | | |
|---|---|---|---|
| 56-7877 | 1/1981 | Japan | 242/18 PW |

*Primary Examiner*—Michael R. Mansen
*Attorney, Agent, or Firm*—Lackenbach Siegel Marzullo Aronson & Greenspan, P.C.

[57] ABSTRACT

Spooling apparatus and method utilizing reels having generally radial slots in the end flanges. A filament is guided to a selected reel by a reciprocating traverse sheave. The traverse sheave is moved to one axial end of the full reel to arrange the filament in a winding reference plane adjacent to the inside surface of the flange at that end. A transfer sheave, which moves between the two reels in the winding reference plane engages the advancing filament and deflects it proximate to the empty reel to position a portion of the filament in a direction substantially tangent with the periphery of the empty reel while winding of the filament continues to the other reel. A throw pin momentarily deflects the filament from the winding reference plane to a cutting reference plane on the other side of the flange which places the filament in a position to be snagged by a snagger that rotates with the empty reel and cut on a stationary cutting element in the cutting reference plane. As soon as the filament is cut the snagged end is guided onto a spiral track, outside of the reel, to guide the filament from the point of snagging at the periphery of the flange to a point corresponding to the surface of the reel drum. A long end is formed on the track within one turn of the reel, and the filament is thereafter guided through the radial slot to be deposited on the empty reel drum for continued spooling. By leading the long end of the filament through a slot in the flange directly onto the drum, the filament is subjected to minimum stresses, deformations and bending while providing desired long ends.

19 Claims, 6 Drawing Sheets

APPARATUS FOR AND METHOD OF CONTINUOUSLY SPOOLING A FILAMENT ON REELS WITH ACCESSIBLE LONG INSIDE ENDS

BACKGROUND OF THE INVENTION

The present invention generally relates to spooling and winding machinery, and more specifically to a spooling method and apparatus for continuously winding a continuous filament on reels with accessible long inside ends.

It is conventional for wire to be taken from a drawing machine or an extruder and continuously spooled on a pair of associated reels. See, for example, U.S. Pat. Nos. 2,763,442; 3,086,721; 3368,765 and 4,119,278, all of which have been assigned to Syncro Machine Company of Perth Amboy N.J. As will be appreciated, it is undesirable for the wire-drawing machine or extruder to be shut down to transfer the wire feed from a filled reel to an empty one. Therefore, means have been devised to automatically shift the wire from a full reel to an empty one while the wire-drawing machine or extruder remains in operation with minimum disruption.

In a variety of applications of spooled wire, it is frequently desirable that both the starting (or inside) and terminal (or outer) ends of the wire of the full reel be readily accessible prior to unwinding. This simplifies testing of the wound reels and "downstream" processes, since ends can be joined to assure continuous operation. For this purpose, it is preferred that the inside wire end has a desired pre selected length, typically 3–10 feet so as to facilitate such a process.

Virtually all of the devices which have hitherto been proposed for providing a long free inner-end on a reel uses some variations of a false coiling core, either a separate auxiliary spool, separate from the main core, or a structure which is build into the flanges of the main winding core. In many of the prior art spooling arrangements, a dummy spool is used adjacent to a main spool and the wire must go over the flanges when the long end is formed. This frequently results in an instantaneous change in the velocity with a resultant increase in the tension of the wire as the wire crosses over the flange from one diameter to the other. Such changes in tension and abrupt discontinuities in the movements of the wire often creates elongation and breakage of the wire. As objectionable as such deformations and stresses are for conventional wires or cables, they become intolerable in connection with fiber optic cables which have characteristic parameters which are particularly sensitive to bending, stretching and other deformations.

At relatively high speeds of feeding of a filament, such as a wire or cable, even one second may represent many feet of movement. Even small errors, therefore, in the timing of feeding wire onto the false or dummy spool can create many feet of unnecessary and undesired wire on the long end which has to be cut off and discarded as scrap.

For the aforementioned spoolers described in the aforementioned patents, the lengths of the inside long ends can be controlled somewhat better as the speed of the drawing or extrusion line is reduced during the period that the long ends are produced. However, this may significantly and adversely affect the productivity of the line since one must not only consider the time taken to slow down the spooler but also the time to bring the entire line back to its normal operating speed.

Also known are continuous operation stranding reels normally used for spooling bare wire. Such reels typically have a generally radial groove on the inside surface of the reel flange. However, such internal slot does not produce a long end. Other reels that are used to produce long ends run the filament generally radially along the inside surface of the reel flange. However, such radial filament portion and subsequent turns on the reel press against each other, and the radial portion or the abutting turns or both are compressed or knicked. This is a particularly serious problem in connection with optical cables or filaments since their optical properties are very sensitive to geometrical dimensions and configurations.

Other disadvantages of the prior art spoolers include the fact that they frequently scratch the wire, particularly as the wire is guided over the reel flanges between the main and the dummy spools. Additionally, the spoolers of the type under discussion cannot normally be used, for example, when winding aluminum or hard filament materials. The movement of such hard filaments over the flange, as suggested above, and change in the velocity of the wire, can result in the breakage of the wire.

The long ends are used not only for attachment to a previous length of cable in a continuous process but are also used to conduct measurements of the cable on the wound reels, using both ends of the wire or cable. Any damage to such wire, cable or filament which is reflected by abnormal readings may require that the entire length of cable on the reel be discarded. The free ends, whether long or short, are, therefore, critical and must be safeguarded during the spooling operation, particularly if such cable includes optical fibers.

SUMMARY OF THE INVENTION

Accordingly, it is an object of the present invention to provide a spooling apparatus for continuously winding of a continuous filament on reels which does not have the disadvantages inherent in prior arts spooling apparatus.

It is another object of the present invention to provide a continuous spooling apparatus which is simple in construction and economical to manufacture.

It is still another object of the present invention to provide a continuous spooling apparatus as in the previous objects which minimizes bending and tensile forces on the filament being wound.

It is yet another object of the present invention to provide a spooling apparatus of the type aforementioned which is particularly useful for spooling or winding optical fibers and/or optical fiber cables.

It is a further object of the present invention to provide a spooling apparatus as suggested by the previous objects which protects the cable ends of the wound spool.

It is still a further object of the present invention to provide a method of winding a continuous filament with accessible long inside ends which minimizes bending and/or tensile stresses on the filament being wound.

It is yet a further object to provide a spooling apparatus for spooling reels with accessible long ends in which all the turns on the reel are free of contact with any radial filament that extends along the inside surface of a flange to avoid compression or knicking of any portion of the filament.

It is an additional object of the present invention to provide a slotted reel of the type that can be used in connection with the aforementioned apparatus and method.

In order to achieve the above objects, as well as others which will become apparent hereinafter, a spooling apparatus in accordance with the present invention is used for continuously winding a continuous filament on reels each having a cylindrical drum and circular end flanges at each axial end of the drum. The apparatus comprises support means for supporting two spaced reels for rotation about substantially parallel axes and for substantially aligning one set of corresponding flanges of the reels within a region between a spaced, substantially parallel winding reference plane and cutting reference plane that are substantially normal to said axes. Guide means is provided for guiding the filament to one of the reels while the other of the reels is empty, said guide means including positioning means for selectively guiding the filament to said winding reference plane during transfer of spooling to an empty reel and to position at least a portion of the filament in a direction substantially tangent with the periphery of the flange of the empty reel just prior to changeover of spooling to the empty reel while permitting continued winding of the filament on the other, wound reel. Deflection means is provided between the reels for momentarily deflecting the advancing filament from said winding to said cutting reference planes just prior to snagging and cutting of the filament while maintaining the advancing filament in said substantially tangent orientation. Cutting means is provided in said cutting reference plane for cutting the filament at said substantially tangent portion. Snagging means are provided for snagging the filament and cutting the filament on said cutting means and retaining an upstream end of the cut filament substantially at the periphery of the flange of the empty reel at an outer radial position while permitting the downstream end to rotate with the other or wound reel. Long end storage means is provided for storing a long end prior to spooling the empty reel, said long end storage means comprising an elongated path arranged in said cutting reference plane and which gradually extends from said snagging means at the flange periphery to intermediate radial position substantially co-extensive with the surface of the empty reel drum. The flange of the empty reel drum is arranged between said winding and cutting reference planes provided with a generally radial slot which extends substantially from a point on the periphery of the flange just prior to the position of said snagging means to said intermediate radial position on said elongated path. In this matter, said positioning means causes the filament to deposit a long length along said elongate path and enters said radial slot to provide a smooth transition of movement of the filament from said elongate path and said cutting reference plane to the drum of the empty reel and said winding reference plane. Drive means is provided for driving said reels at selected speeds and for initially driving the empty reel at a first speed when the filament is pulled into said cutting reference plane. Control means is provided for accelerating the speed of rotation of the empty reel from said first speed as the filament is initially deposited along said elongate path to a higher, second speed as the filament is removed from said elongate path and applied to the drum of the empty reel to at least partially variable radial distances from the time that the filament is cut and held at the rim of the empty reel to the time that the filament is initially wound on the drum of the empty reel. In this matter, the filament is subjected to minimal bending and tensile stresses during transfer of spooling from one reel to the other.

The invention also pertains to the method of continuously winding a filament on reels with accessible long inside ends, as suggested, and to the reels provided with the radial slots in at least one of the flanges in order to practice the method and use the apparatus.

BRIEF DESCRIPTION OF THE DRAWINGS

The aforementioned objects and other features of the present invention will become more apparent from the following description in conjunction with the accompanying drawings, wherein.

DESCRIPTION OF THE PREFERRED EMBODIMENTS

Figure 1:
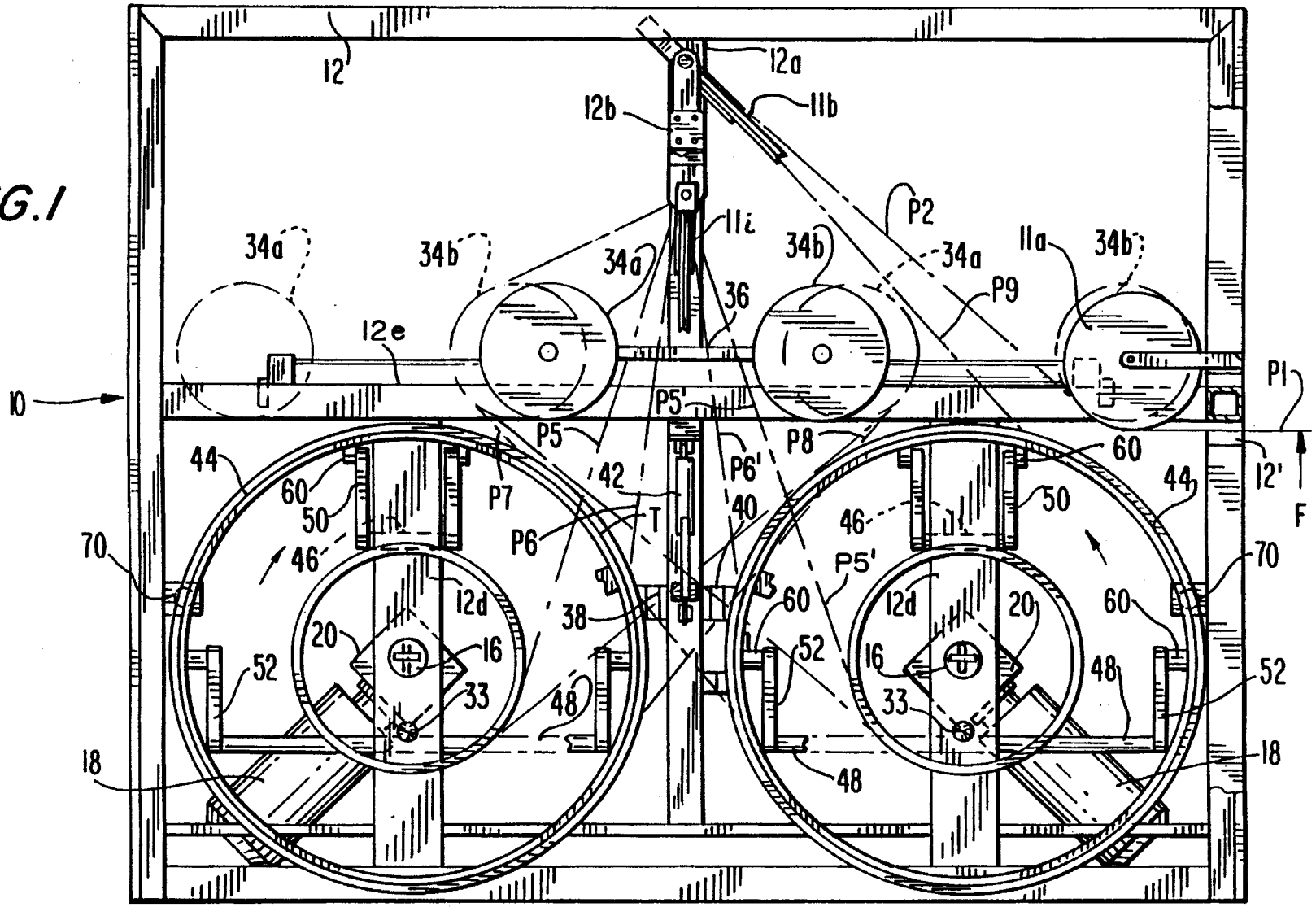
FIG. 1 is a front elevational view of a spooling apparatus in accordance with the present invention for providing accessible long inside ends, showing the apparatus in a condition just prior to the transfer of spooling from the right bobbin or reel to the bobbin or reel on the left, as viewed in the figure.

Referring now specifically to the figures, in which identical or similar parts are designated by the same reference numerals throughout, and first referring to FIG. 1, the reference numeral 10 generally designates the spooling apparatus for continuously winding of a continuous filament on reels in accordance with the present invention.

The apparatus 10 includes a generally rectangular frame and cover assembly 12 which supports and covers many of the moving components to be described. The frame 12 includes an upright support member 12*a*, horizontal support members 12*b*, 12*c* and vertical support members 12*d*, as shown. It will be evident to those skilled in the art that these aforementioned support members are merely illustrative and any other support structures may be used for supporting the elements or components to be described, with different degrees of advantages. These specific support members used are not, therefore, critical.

Referring to FIG. 1, a filament F is introduced into the apparatus 10 along path P1 through a suitable opening 12'. Filament F can originate from any suitable source, such as an extruder, an external series of reels or bobbins, etc. Typically, with spooling machinery of the type to be described, it is important that the filament F be advanced at a substantially fixed or constant linear velocity, unless compensating components, such as accumulators, are used in the line feeding the spoolers. Disruptions in such linear velocity may result in disruptions of an entire line of machinery (which produces the filament) which would materially reduce the speed and efficiency of operation of the overall line. It is to be understood, therefore, that the description of the apparatus 10, and of its operation, is based upon the premise that the filament F enters the machine at the 12' at a substantially constant linear velocity, unless a compensating element, such as an accumulator, is used, as to be more fully discussed below.

Figure 2:
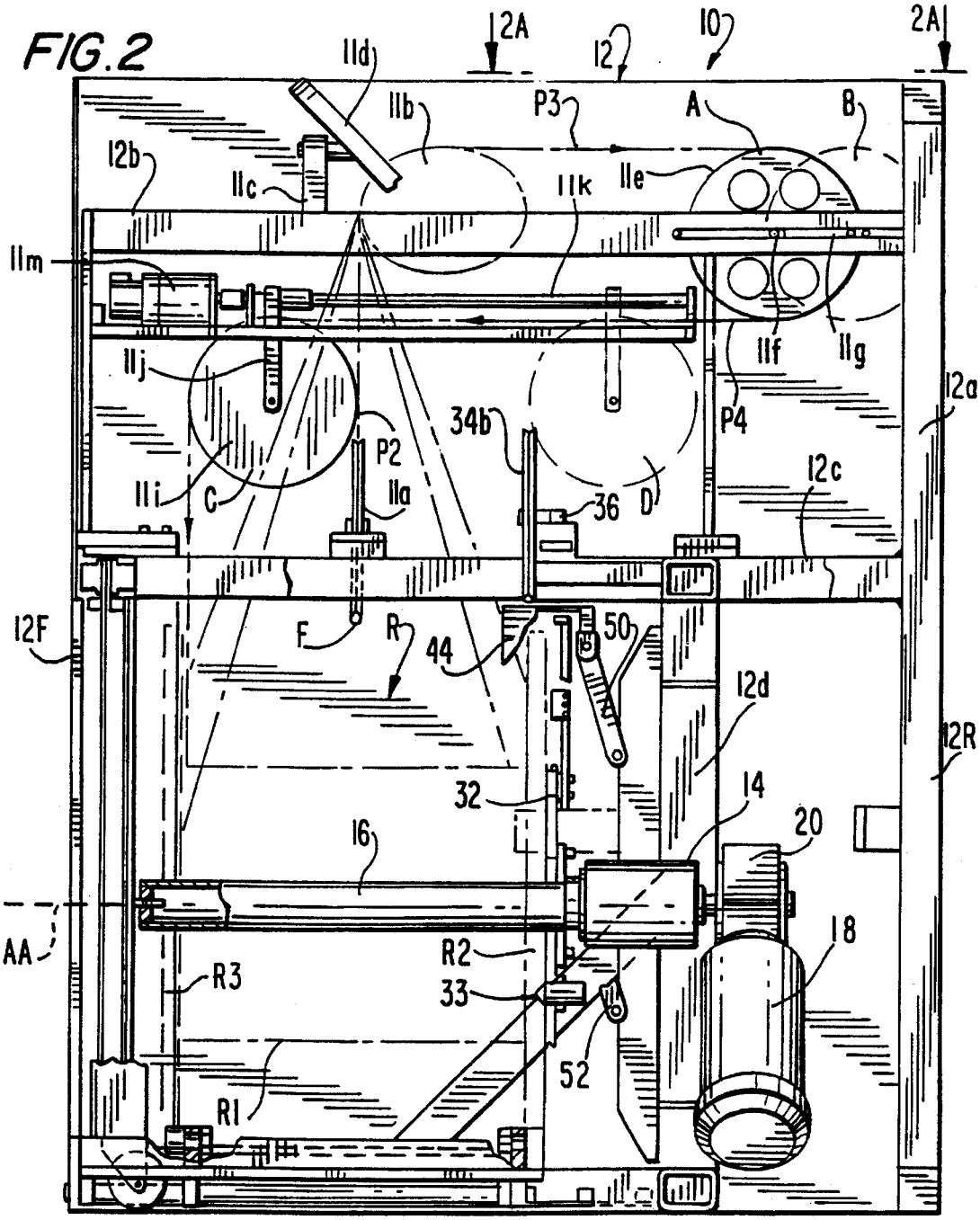
FIG. 2 is a side elevational view of the apparatus shown in FIG. 1, showing the spools or reels in phantom outline.
Figure 2A:
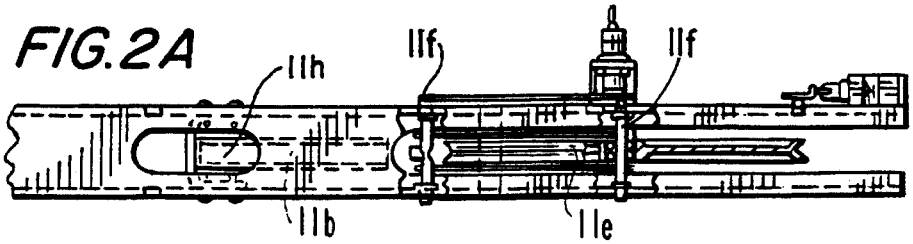
FIG. 2A is a fragmented top plane view of FIG. 2, viewed along line 2A—2A, and showing mounting details for the dancer sheave.

When filament F is introduced into the machine 10 it is first deflected by a fixed entrance sheave or pulley 11*a* which deflects the filament upwardly along path P2 to a deflection sheave 11*b*, as can be seen in both FIGS. 1 and 2. The purpose of the sheave 11*b* is to deflect the incoming filament along a path P3, which is substantially horizontal as viewed in FIG. 2 although, clearly, the specific orientation of the path P3 is not critical for reasons which will become evident. The sheave 11*b* is suitably mounted on the support member 12*b* by means of a bracket 11*c* and support arm lid. The filament is directed from path P3 around a dancer sheave or pulley 11*e* which is slidably mounted for generally horizontal movements along the support member 12*b*. This can be achieved in any one of a number of different ways. One example, which is illustrated in FIGS. 2 and 2A, includes a pair of opposing slots 11*g* on each side of the support member 12*b*. Suitable transverse shafts or pins 11*f* are mounted on a sliding bracket which supports the dancer 11*e*, which shafts or pins 11*f* extend through the slot 11*g* for allowing the dancer 11*e* to move from a forward position A (shown in solid outline) which is closest to the front of the machine 12F and to a rearward position B (shown in phantom outline) which is closest to the rear of the machine 12R.

Suitable biasing means is provided for normally urging the dancer 11*e* to move towards the position B. Such biasing means for urging the dancer rearwardly can consist of any one of a number of different known devices, including springs, hydraulic or pneumatic cylinders that are pressurized at desired levels, etc. In the presently preferred embodiment, an air cylinder 11*h* is mounted within the support member 12*b*, which includes a piston rod which is coupled to the dancer 11*e* sliding mechanism for urging the dancer to position B by a preset or pre-selected air pressure applied to the air cylinder. When the tension in the filament increases, the forces applied on the dancer 11*e* move the dancer towards the front of the machine 12F, against the action of the air cylinder 11*h*, to assume a position to the left of position B, and move to leftmost position A in extreme conditions where such forces exceed a predetermined limit. It will be clear, therefore, that the dancer sheave 11*e* operates in a typical manner to take up slack in the filament and maintain substantially uniform tensions therein, as is common in machines of this type. Advantageously the air cylinder 11*h* is provided with a potentiometer (not shown) that provides a variable resistance as the position of the piston rod changes to provide feedback to a control circuit which maintains the tension in the filament.

Once the filament F extends about the dancer 11*e* it exits along path P4, which is also along an essentially horizontal direction in the central region of the apparatus 10, in proximity to the vertical support member 12*a*. Path P4 takes the filament F to traverse sheave 11*i* which is supported by means of a supporting bracket 11*j* on a traverse screw 11*k* selectively controlled by a traverse motor 11*m*. The traverse sheave 11*i* is arranged to receive the filament F as it leaves the dancer 11*e*. It will also be clear from FIG. 2 that the traverse sheave 11*i* is movable between a position C, most proximate to the front of the machine 12F (shown in solid outline) and a position D most proximate to the rear of the machine 12R (shown in phantom outline). Such movements of the traverse sheave 11*i* are controlled by the traverse motor 11*m* which selectively rotates the traverse screw 11*k*. The traverse sheave 11*i* also pivots with the support bracket 11*j* about the traverse screw 11*k*, to accommodate the various feed angles to both the reels on both sides of the traverse mechanism, as suggested by paths P5, P6 (for the left reel) and paths P5', P6', (for the right reel) in FIG. 1.

Figure 3:
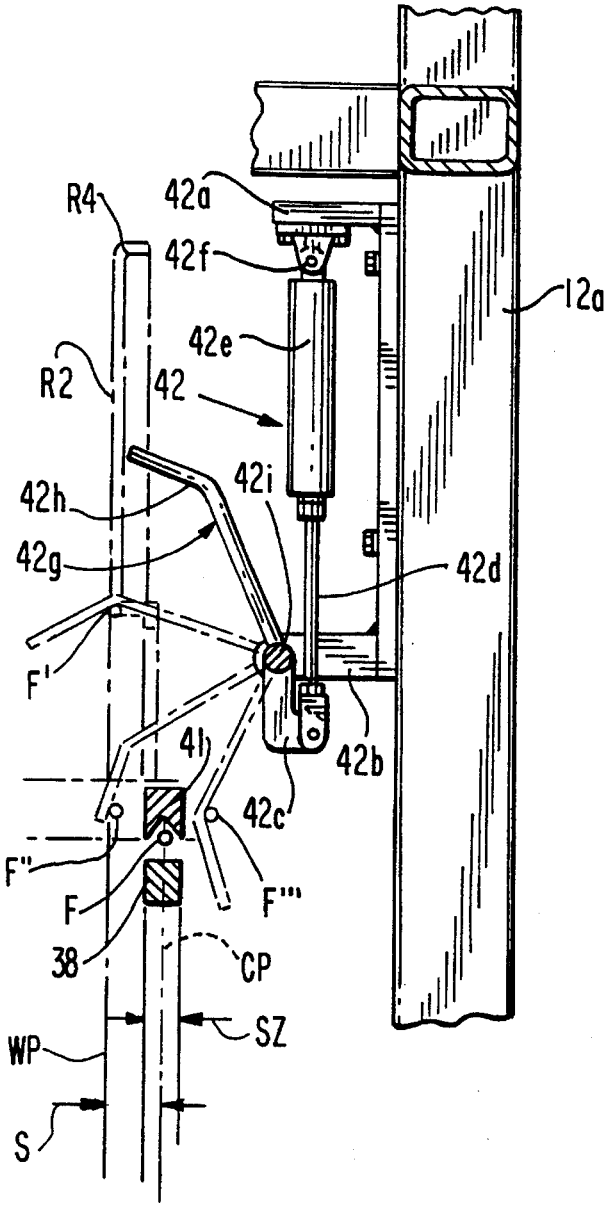
FIG. 3 is an enlarged detail of the deflecting mechanism situated between the two bobbins for momentarily deflecting the advancing filament from a winding reference plane to a filament cutting reference plane just prior to transfer of spooling from one reel to the other.
Figure 4:
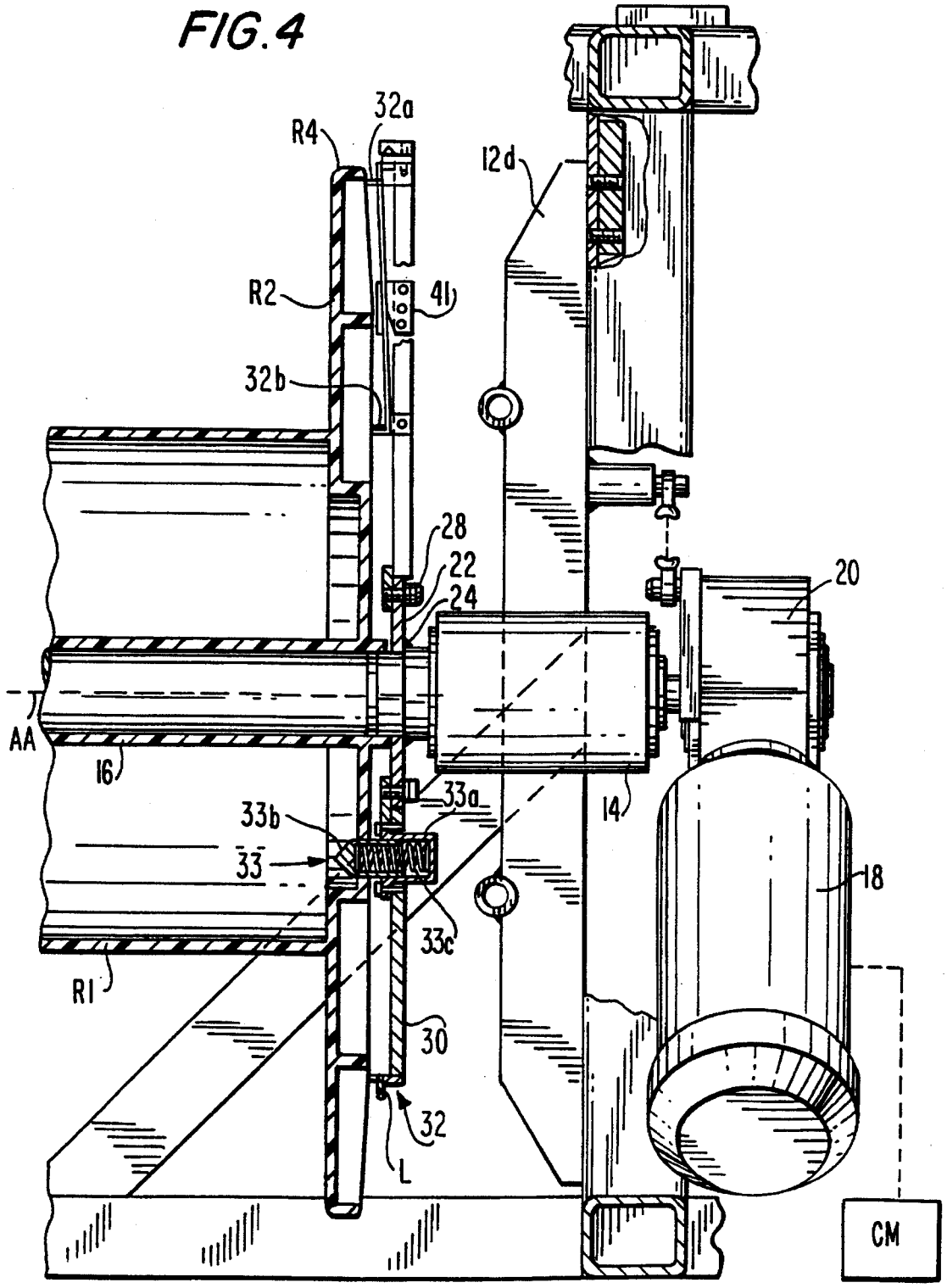
FIG. 4 is an enlarged detail of that portion of the apparatus shown in FIGS. 1 and 2 which includes the bobbin supporting shaft for one of the bobbins or reels, and illustrating the details of a long end storage path or track situated behind the empty reel to be wound.

As best shown in FIGS. 2–4, the apparatus 10 to be used with reels R (shown in phantom outline) each of which has a cylindrical drum R1 and circular end flanges R2, R3 at each axial end of the drum R1.

The apparatus 10 is provided with means for supporting two spaced reels for rotation about substantially parallel axes. In FIGS. 1, 2 and 4 such a support is shown as including a bearing 14 mounted on the vertical support member 12*d* which rotatably supports a shaft 16 having a generally horizontal axis AA and which substantially aligns one flange R2 of the supported reel within a region S (FIG. 3) which is provided between a winding reference plane WP and a winding reference plane CP that are substantially normal to the axis AA of the supporting shaft 16. Although the specific positions of the winding and cutting reference planes are not critical, they are advantageously provided on opposing sides of the flanges R2, the cutting reference plane CP being essentially just on the inside of the flange R2 while the cutting reference plane CP being essentially just on the outside of or exterior of the flange R2.

The entrance sheave 11*a*, the upper guide sheave 11*b* and the traverse sheave 11*i* together form guide means for guiding the filament F to one of the reels R while the other of the reels is empty. For purposes of the description that follows it will be assumed that the reel R on the right side of FIG. 1 is wound to a point where a transfer of spooling is to take place to the reel on the left side (i.e. the right reel is fully wound), it being understood that similar structures and steps will be applicable when transferring spooling from the reel on the left side to the one on the right.

The traverse sheave 11*i*, which forms part of the guide system for the filament, serves as a positioning member for selectively guiding the filament F to the winding reference plane WP at the commencement of transfer to an empty reel. It will be clear, therefore, that whenever the machine itself senses (or an operator determines) that the wound spool (e.g. the reel on the right side of FIG. 1 in the example) is sufficiently wound, a suitable signal is applied to the traverse motor 11*m* to move the traverse sheave 11*i* to the rear of the machine 12R, from whatever position it is in, to position D to place the downwardly directed filament F within the winding reference plane WP.

Contemporaneously, a carriage 36 is moved along the support member 12*e* towards the left to move transfer sheaves 34*a*, 34*b* to their leftmost positions as shown in phantom outline in FIG. 1. Since the transfer sheaves 34*a*, 34*b* are also positioned within the winding reference plane WP, the movement of the carriage 36 to the leftmost position causes the transfer sheave 34*b* (on the right side as viewed in FIG. 1 ) to engage the filament F until the filament is guided along the path P7 (path P8 when transfer is in the opposite direction). In that deflected condition, at least a portion of the filament is in an orientation substantially tangent to the periphery of the flange (at T) of the empty reel (the one on the left side) just prior to transfer of spooling. However, the filament continues to be fed, via the transfer sheave 34*b*, to wind the filament on the other, wound reel (shown on the right in FIG. 1).

Provided between the reels R, and mounted on the vertical support member 12*a* there is provided a deflection means 42 for momentarily deflecting the advancing filament F from the winding reference plane WP to the cutting reference plane CP just prior to snagging and cutting of the filament, while maintaining the advancing filament in the substantially tangent orientation represented by the path P7. The deflecting means can be of any suitable construction, a presently preferred embodiment of such deflection means 42 being illustrated in FIG. 3. The deflecting means 42 includes upper and lower brackets 42*a*, 42*b* mounted on the vertical or upright support member 12*a*. An L-shaped crank lever 42*c* is pivotally mounted on the lower bracket 42*b* by means of pin 42*i*, a piston rod 42*d* being connected to one end of the crank lever 42*c*. The rod 42*d* forms part of an actuating cylinder 42*e* which has its cylindrical housing pivotally connected to the upper bracket 42*a* by a pivot pin 42*f*. Connected to the L-shaped 42*c* is an elongate throw pin 42*g* which is normally arranged to remain behind the winding reference plane WP, when the rod 42*d* is fully extended. Just prior to severance of the filament and transfer of spooling from the right reel to the left reel, as viewed in FIG. 1, an appropriate signal or pressure is applied to the cylinder 42*e* to cause retraction of the rod 42*d* and thereby pivot of the throw pin 42*g* in a counter clockwise direction, as suggested by the dashed outlines in FIG. 3. Thus, with the filament F initially at position F' in the winding reference plane WP, the downwardly moving throw pin 42*g* engages the filament at position F' and urges the filament downwardly, first to position F" (still shown in the winding reference plane WP). However, subsequently, the throw pin 42*g* urges the filament to move outside and rearwardly of the winding reference plane WP and behind the operative positions of the filament F in the space S and the cutting reference plane CP. As shown in FIG. 3, the filament, at F'", is actually deflected rearwardly even beyond the storage zone or area SZ which is located behind or rearwardly of the cutting reference plane CP. It is evident, therefore, that the throw pin 42*g* is instrumental in capturing the filament F while it is on one side of the flange R2 and deflecting it to the other side of the flange. The operation of the deflecting mechanism 42 will be further described below.

Figure 7:
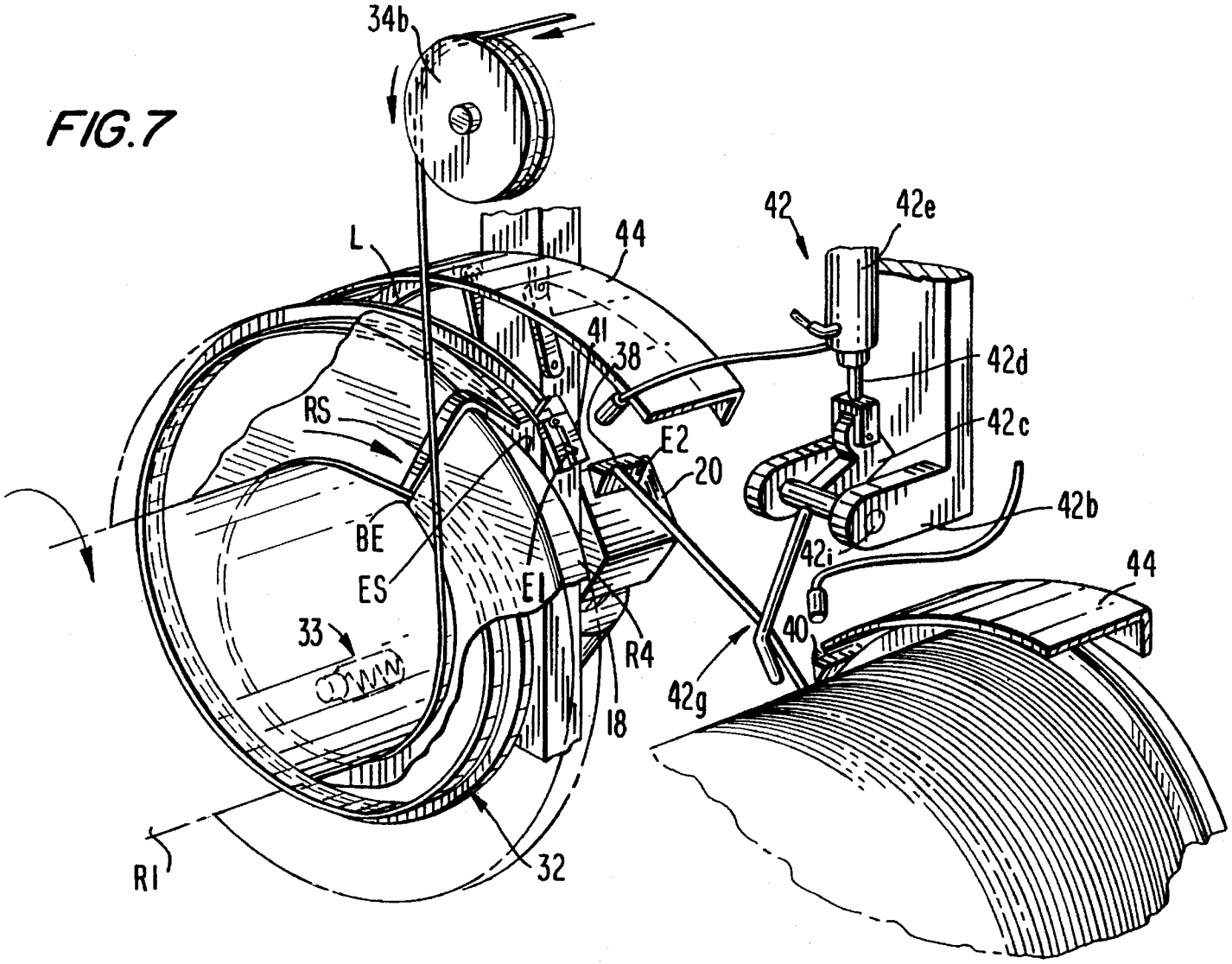
FIG. 7 is a partial view, in perspective, of one of the reels shortly after transfer of spooling to that reel, and also showing position of throw pin and filament at the moment of cutting of the filament.

Each of the shafts 16 is connected to a motor 18 through a converter or transmission 20 for driving the reels at selected speeds. The specific nature of the drives is not critical and any arrangement for driving the reels at selected speeds may be used. In the apparatus 10, the motors 18 are controlled to initially drive an empty reel at a first, lower speed substantially corresponding to the linear velocity of the periphery of the flange when the filament is first pulled into the cutting reference plane CP and the upstream cut end E1 is snagged at the periphery of the reel flange (FIG. 7). As best shown in FIGS. 1, 3 and 7, a cutter 38 is positioned proximate to the periphery of the flange of the reel mounted on the left side of the apparatus (at T) while the corresponding cutter assembly 40 is similarly mounted proximate to the periphery of the flange of the reel mounted on the right shaft 16. Once the throw pin 42*g* deflects the filament to the position F'", it will be evident that the filament will pass just above the cutter assembly 38 and in the path of a snagger 41 (FIG. 3) which rotates with the empty reel and engages the filament as the filament extends from the winding reference plane WP, as it leaves the transfer sheave 34*b*, to the position at F'". The snagger 41 grips the filament and forces it to cross the cutting edge of cutter 38 and continues to hold the upstream end E1 of the cut filament substantially at the periphery of the flange of the empty reel (on the left) while permitting the downstream end E2 of the cut filament to continue to be wound onto the other full reel on the right side of the apparatus.

In order to provide the wound reels with accessible long inside ends, a long end storage device is provided for storing a long end prior to spooling of the empty reel. In the presently preferred embodiment, the long end storage device is in the form of an elongated path arranged in the cutting reference plane CP which gradually extends from the snagger 41 at the flange periphery R4 to an intermediate radial position which substantially corresponds to the radial dimension of the surface of the empty reel drum R1. As will be noted from FIG. 7, the flange R2 of the empty reel, which is arranged between the winding and cutting reference planes WP, CP, is provided with a generally radial slot RS which extends substantially from a point on the periphery R4 of the flange just prior to the position of the snagger 41 to the intermediate radial position R1 on the elongate path. In the presently preferred embodiment, the elongate path comprises a spiral track 32 which has an outer end 32*a* which is positioned proximate to the slot RS of the empty reel at the time that the empty reel is mounted on its shaft 16, and an inner end 32*b* which is arranged on the other side of the slot RS within the flange R2, but at the surface of the drum R1.

As shown in FIG. 4, the track 32 is mounted on a plate 22 which is secured to the shaft 16 by means, for example, of a weld 24. A support bar 30 extends through the shaft 16 and extends at the upper end (FIGS. 4 and 5) to a region somewhat beyond the rim R4 of the flange, while the opposite end of the bar 30 substantially ends at the portion of the spiral track which crosses the support bar 30. The end which extends beyond the rim of the flange supports the snagger 41 and is just downstream of the outer end 32*a* of the track, in relation to the clockwise direction of rotation of the shaft 16 as viewed in FIG. 5. The long end storage track 32 is secured, via the support bar 30, to the circular plate 22 by means of an annular ring 26 which is secured to the support bar 30, by means of bolts 28. The spiral track 32 may be secured to the support bar 30 in any other conventional way, such as by welding.

It will be appreciated that the long end storage assembly 32 is secured to the shaft 16 and remains in the position shown, namely in the storage zone or area SZ, as shown in FIG. 3. When a bobbin is mounted on a shaft 16 it is rotated relative to the support bar 30 and the storage track 32 so as to place the slot RS of the respective flange within the space S so as to be arranged just downstream of the snagger 41.

In order to prevent relative rotation between reel R and the long end storage assembly 32 there is advantageously provided a holding device or dog pin 33 mounted on the support bar 30 which rotates with the shaft 16. The dog pin 33 is shown to include a cylindrical housing 33*a* with a cylindrical pin 33*b* slidably mounted within the housing 33*a*, with a spring 33*c* extending therebetween so as to apply a biasing force on the cylindrical pin 33*b* towards the flange R2. The flange is provided with a suitably dimensioned opening therein radially spaced from the shaft 16 to correspond with the position of the cylindrical pin 33*b* so that once the reel is angularly aligned with the long end storage assembly the cylindrical pin is urged into the appropriate aperture or hole within the flange so as to lock the flange and prevent relative rotation between the flange and the long end storage assembly. Any other suitable or appropriate means may be used to lock the reel against rotation relative to the shaft 16.

Control means CM (FIG. 4) is provided for accelerating the speed of rotation of the empty reel from a first speed as the filament is initially deposited on the track 32 (at the outer end 32*a*) to a higher second speed as the filament is removed from the track 32*b* and applied to the drum R1 in order to at least partially compensate for the differences in diameters at the rim or periphery R4 of the flange and at the surface of the drum. For relatively low spooling speeds (e.g. 300 meters per minute) it is feasible to accelerate the empty reel from approximately 96 rpm when the filament is first applied to the outer end 32*a* of the track to approximately 192 rpm when the filament leaves the inner end 32*b* of the track and is applied to the surface of the drum. Such acceleration, which approximately doubles the speed of rotation of the bobbin or reel, is possible when the relative radii at the entrance and exit points on the spiral track are in ratio of approximately 2 to 1. Such acceleration, which approximately doubles the speed, is possible with standard plastic reels, at relatively low rpm as aforementioned, without the use of excessively powerful motors. However, as the rotational speed increases, it may not be possible to adequately accelerate the empty reel without using extremely powerful motors, which might not always be justified. Thus, for high speed applications (e.g. 2,400 meters per minute) it would be impractical to accelerate the empty reel from approximately 1,213 rpm to approximately 2,426 rpm in one turn of the reel. In such applications, it may be necessary to utilize an accumulator upstream of the spooling apparatus so that any deficiencies in the acceleration can be compensated by accumulating the cable before entering the spooling apparatus without disrupting the substantially constant linear velocity of the cable from the line. Of course, where an accumulator is used, the motor controlling the empty reel must be suitably initially accelerated to remove the accumulated cable within the accumulator, until such accumulation has been exhausted. At such time, the motor can be regulated to maintain the desired speed of the reel to spool the wire at a rate that is compatible with the line.

Referring for FIGS. 3 and 4, it will be noted that the spacing S between the winding and cutting reference planes WP and CP substantially corresponds to the axial thickness of the reel flange R2. However, such spacing is not critical and may vary slightly from such thickness without substantially departing from the spirit of the invention.

During normal spooling operations, the traverse sheave 11*i*, in conjunction with the traverse motor 11*m* and traverse screw 11*k*, reciprocates along the axial width of the reel being wound to uniformly deposit the filament across the entire width of the reel while the reel is being spooled. The traverse sheave 11*i* is movable to the transfer position to place the advancing filament in the winding reference plane WP, as aforementioned, only when transfer of spooling is to be affected from a wound or full reel to a empty reel. In this connection, while the guide system for the filament has been described as a system of sheaves of pulleys, it will be understood and appreciated by those skilled in the art that one or more said sheaves may be replaced by other equivalent components, such as ceramic bars or eyelets. The function of most of these sheaves is simply to deflect the cable and any deviation or deflection system may be used with different degrees of advantage. This is particularly true for high speeds spooling applications, where significant acceleration of the empty reel must take place, since inertia of the sheaves may have an adverse effect on the operation of the system. In such case, ceramic or low friction bars or deflection members may be used in place of sheaves.

Figure 5:
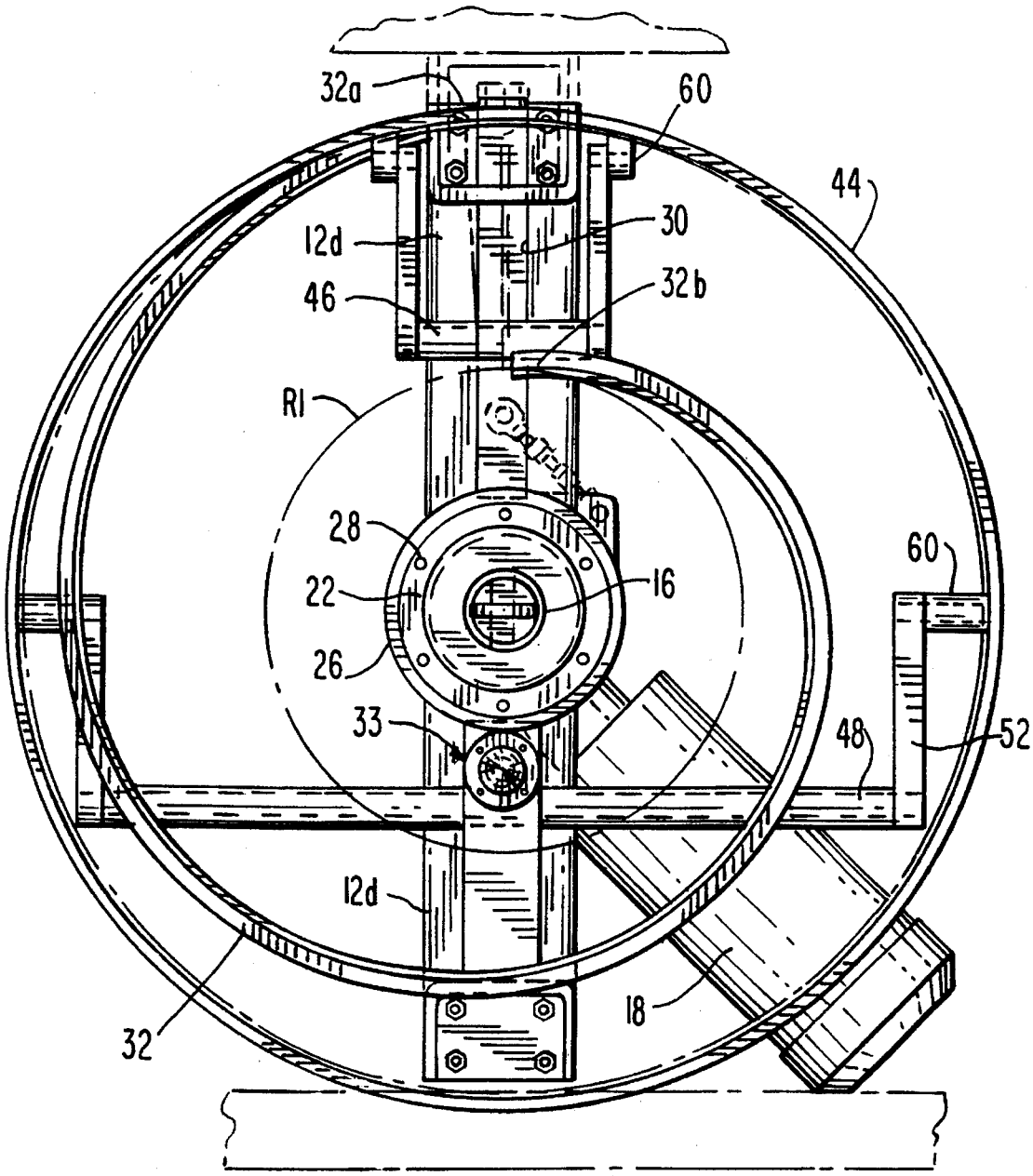
FIG. 5 is a front elevational view of the reel supporting shaft and the long end storage track or guide illustrated in FIG. 4.

In the disclosed embodiment as evident FIGS. 4 and 5, the spiral track 32 has an L-shaped cross section to form a retaining lip L for retaining the filament between the retaining lip and the flange R2 of the empty reel during formation of the long end, as the reel makes one revolution between the time that the filament is cut and the time that it is applied to the drum R1 of the reel.

Advantageously, the rim of the flange R2 is provided with a smooth entrance surface ES (FIG. 7) that leads into the radial slot RS and guides the filament through the radial slot from the cutting reference plane CP back to the winding reference plane WP.

Figure 6:
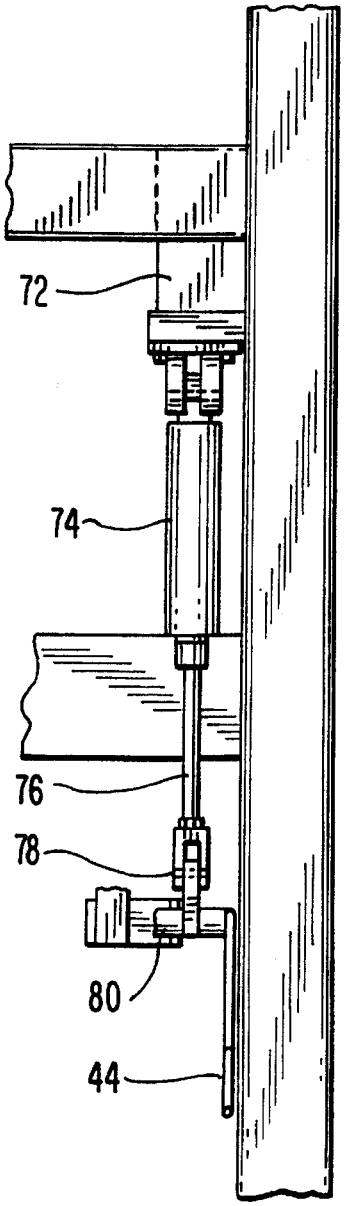
FIG. 6 is an enlarged detail, in top plan view, of a cylinder for moving a protective shield to and from a position which covers at least a portion of the wound reel to protect a loose outer ends of the filament after it is cut.

Optionally and advantageously, there is further provided a shield for shielding the downstream end E2 of the cut filament as it rotates with the full reel from which continued spooling has terminated. Referring to FIGS. 2 and 6, the shield consists of a generally cylindrical guard or shroud 44 which has a diameter substantially corresponding to the outer diameter of the reel R2, R3 flanges to at least partially receive an associated reel with close tolerance and selectively cover at least the reel flange R2 and a portion of the reel barrel proximate to the reel flange which includes the winding reference plane WP. In this manner, the downstream end E2 of the cut filament only engages the cylindrical shield 44 upon the filament being cut to minimize damage to the outer end E2 of the wound filament on the full reel.

In FIG. 6, activation means is illustrated for moving the shield 44 form a normal non-shielding position, axially spaced from an associated reel R, along the direction of the axis of the reel, and a shielding position only during the period between the time that the filament is cut and the wound reel from which transfer of spooling has taken place comes to a stop. Such movements of the shield 44 is achieved, in the preferred embodiment, by means of an upper pivot shaft 46 fixedly mounted on the upright support member 12*d* and a larger, lower pivot shaft 48, both shafts 46 and 48 being fixedly mounted on the upright support member 12*d*. The shield 44 is coupled to the pivot shafts 46, 48 by means of articulated upper arms 50 and lower arms 52 pivotly connected to connecting lugs 60 fixed on the shield, as best shown in FIG. 1. As indicated in FIG. 2 the articulated or pivoted arms 50 and 52 can move forwardly or rearwardly while essentially maintaining the shield 44 in a condition coaxial with the shaft 16. A hydraulic or pneumatic cylinder is illustrated in FIG. 6 which is used to advance or retract the shield 44 over the reel, and includes a lug 72 forming part of the frame 12 to which there is pivotly mounted a hydraulic or pneumatic cylinder 74 which includes a piston shaft or rod 76 the free end of which is pivotly connected at 78 to the lugs 80 on the shield 44. It is clear that when suitable hydraulic or pneumatic pressure is applied to the cylinder 74 the rod 76 is retracted into the cylinder and the shield 44 is pulled towards the rear 12R of the machine housing or frame 12. As soon as the filament has been cut and the free end E2 is permitted to be taken up on the full reel shown, for example, on the right of the apparatus in FIG. 1, the shield on the right is advanced forwardly to cover at least that portion of the bobbin or reel which covers the winding plane WP wherein the trailing free end E2 of the filament which had just been cut is permitted to spin until the full reel on the right side until it stops to rotate. Such a shield protects the outside free end E2 of the filament to avoid damage thereto, and at the same time, prevents the free end E2 from being propelled and injuring personnel in the proximity of the machine. However, the use of shields or guards for this purpose are well known and the apparatus and method of the present invention can be used without such shields.

The method of the invention, and the operation of the apparatus, will now be described. When the filament F enters the machine at 12' it can be fed directly to the machine from a source of a continuous filament or from an accumulator. As indicated, an accumulator may need to be used if the size, weight of the reels and the power of the motor driving the reels are such that it would be impossible to sufficiently accelerate the empty reel to compensate for the difference in speeds that would be required during a single turn during which the long end is formed along the storage track 32. Once the filament enters the machine 10, it is deflected by a system of guide pulleys or sheaves 11*a*, 11*b*, 11*e* and 11*i* to direct the filament to a reel being wound. Advantageously, the traverse sheave 11*i* is controlled by traverse motor 11*m* to uniformly distribute the cable over the width of the reel. It is assumed, for purposes of this description, that the reel on the right, as viewed in FIG. 1, has been fully wound and the time has come to transfer the spooling to the empty reel on the left. The following sequence of events takes place. The traverse sheave 11*i* is first moved, from any position on the traverse screw 11*k*, to the rightmost position D, as viewed in FIG. 2, to bring the filament F leaving the traverse sheave 11*i* in the winding reference plane WP essentially just inside of the internal surface of the flange R2. Once the filament is in the winding reference plane WP, the carriage 36 commences to move to the left, as viewed in FIG. 1, to move the transfer sheave 34*b* to engage the still advancing filament to assume the path P7 in which at least a portion of the filament is substantially tangent to the periphery of the flange R2 of the empty reel (at T) and passes proximate to the cutter assembly 38. During this time, the filament continues to advance and to be wound on the reel on the right, although such winding takes place in the winding reference plane WP. As soon as the filament is oriented along path P7 as indicated in FIG. 1 the throw pin or deflection finger 42*g* is pivoted downwardly about its pivot pin 42*i* as suggested in FIG. 3 and engages the filament in the winding reference plane WP and deflects it into the path of the snagger 41. This brings the filament directly into contact with the knife or cutting edge of the cutter assembly 38 and the snagger forces the filament against such cutter so as to sever the filament while continuing to retain or hold the upstream end E1 of the filament in the snagger assembly. The other end E2 continues to advance with the still rotating full reel on the right, as viewed in FIG. 1, and such free end is preferably protected by the shield or guard 44 which has by now been pushed over the full reel by means of the actuator assembly shown in FIG. 6, including the actuating cylinder 74. As soon as transfer has been made a brake is advantageously activated to stop rotation of the full reel as quickly as possible.

With regard to the snagged end E1 of the filament on the periphery of the empty reel, it is clear that the rotation of the empty reel, together with the rotation of the spiral storage track 32, causes the filament to become wound about and accumulated upon the spiral track during one revolution of the reel. As indicated, during this time, the motor driving the empty reel is accelerated so as to compensate for the radial differences in the points of application of the filament from the initial point at the snagger at the outer end 32*a* of the spiral track to the point that the filament is applied to the drum R1 when it leaves the inner end 32*b* of the spiral track, passes through the slot RS in the flange of the reel and is deposited onto the drum surface. It should be clear that as soon as the filament is cut, the filament is released from the throw pin 42*g* and the filament seeks to return from the cutting reference plane CP to the winding reference plane WP to which the traverse sheave 11*i* still continues to guide the filament. It is that tendency of the filament to again return from the cutting reference plane CP to the winding reference plane WP that causes the filament to engage the entrance surface ES and to be smoothly guided through the slot RS in the flange and be deposited on the surface of the drum R1.

As soon as the empty reel has made one revolution and the filament has been deposited onto the drum surface, the transfer sheaves are again returned to the center position so that the filament can assume orientations between paths 5 (where the reel is still empty) to the path 6 when the reel becomes full, without interference of the transfer sheaves 34*a*, 34*b*. At the same time, the traverse motor 11*m* is actuated to reciprocate the traverse sheave 11*i* to reciprocate between extreme positions so as to uniformly apply the cable across the entire width of the reel. However since the long end is not introduced radially along the inside surface of the flange but through the bottom end (BE) of the radial slot RS, all of the turns wound on the reel abut against the smooth inside surface of the flange, thereby avoiding knicking or filament compression as was common with prior long end spooling machinery.

It is clear that once the reel on the left has become filled a similar procedure is applied for transferring spooling from the left reel to the right reel.

As suggested in FIG. 1, the machine 10 can also be used to rewind a filament from one reel to another. In such an application, the filament, instead of entering the machine along path P1, is taken off the reel on the right (as viewed in FIG. 1) and is directed towards the sheave 11*b* along path P9. The traverse sheave 11*i* subsequently uniformly applies the filament across the width of the reel mounted on the left of the machine.

It will be appreciated that the apparatus and method of the present invention allow continuous spooling between a full reel and an empty reel with minimal disruption to the line. However, importantly, the method and apparatus of the invention also allow the cable to be spooled with minimum bending, knicking and tensile or other stresses applied to the cable or filament. This is particularly important in connection with optical fibers or filaments since the optical properties of such filaments or cables are extremely sensitive to stresses or deformations.

While this invention has been described in detail with particular reference to a preferred embodiment thereof, it will be understood that variations and modification will be affected within the spirit and scope of the invention as described herein and as defined in the appended claims.

I claim:

1. Spooling apparatus for continuously winding of a continuous advancing filament on reels each having a cylindrical drum and circular end flanges at each axial end of the drum, comprising support means for supporting two spaced reels for rotation about substantially parallel axes and for substantially aligning one set of corresponding flanges of the reels within a region between spaced, substantially parallel winding and cutting reference planes that are substantially normal to said axes; guide means for alternately guiding the filament to one of the reels for spooling, said guide means including positioning means for selectively guiding the filament to said winding reference plane during transfer of spooling to an empty reel and to position at least a portion of the filament in a direction substantially tangent with the periphery of the flange of the empty reel just prior to transfer of spooling to the empty reel while permitting continued winding of the filament on the other, wound reel; deflection means situated between the reels for momentarily deflecting the advancing filament from said winding to said cutting reference planes just prior to snagging and cutting of the filament while maintaining the advancing filament in said substantially tangent orientation; cutting means in said cutting reference plane for cutting the filament at said substantially tangent portion; snagging means for snagging the filament and cutting the filament on said cutting means and retaining an upstream end of the cut filament substantially at the periphery of the flange of the empty reel at an outer radial position while permitting the downstream end to be wound on the wound reel; long end storage means for storing a long end of the filament prior to spooling the empty reel, said long end storage means comprising means for defining an elongate generally spiral path arranged in said cutting reference plane and which gradually extends from said snagging means at the flange periphery to an intermediate radial position substantially co-extensive with the surface of the empty reel drum, the flange of the empty reel drum which is arranged between said winding and cutting reference planes being provided with a generally radial slot which extends substantially from a point on the periphery of the flange just prior to the position of said snagging means to said intermediate radial position on said elongate path, whereby said positioning means causes the filament to deposit a long length along said elongate path and enter said radial slot to provide a smooth transition of movement of the filament from said elongate path in said cutting reference plane to the drum of the empty reel in said winding reference plane; drive means for driving said reels at selected speeds and for initially driving the empty reel at a first speed when the filament is pulled into said cutting reference plane; and control means for accelerating the speed of rotation of the empty reel from said first speed as the filament is initially deposited along said elongate path to a higher, second speed as the filament is removed from said elongate path and applied to the drum of the empty reel to at least partially compensate for variable radial distances from the time that the filament is cut and held at the rim of the empty reel to the time that the filament is initially wound on the drum of the empty reel, and whereby the filament is subjected to minimal bending and tensile stresses during transfer of spooling from one reel to the other.

2. Spooling apparatus as defined in claim 1, wherein the spacing between said winding and cutting reference planes substantially corresponds to the axial thickness of the reel flanges.

3. Spooling apparatus as defined in claim 1, wherein said positioning means includes traverse means for reciprocally traversing the axial width of the empty reel being wound and for uniformly depositing the filament across the width of the reel while the same is being spooled, said traverse sheave being movable to a position to place the advancing filament in said winding reference plane when transfer of spooling is to be affected from a wound reel to an empty reel.

4. Spooling apparatus as defined in claim 3, wherein said positioning means further comprises two transfer sheaves for deflecting the advancing filament within said winding reference plane to dispose said portion of the advancing filament in said orientation substantially tangent with the periphery of the flange of the empty reel just prior to changeover or transfer of spooling of reels each transfer sheave being arranged to deflect the advancing filament to said tangent orientation in relation to another one of the reels to be spooled.

5. Spooling apparatus as defined in claim 4, wherein said two transfer sheaves are mounted on a carriage for movements within a path within said winding reference plane, said path being generally parallel to a plane containing the axes of rotation of the reels.

6. Spooling apparatus as defined in claim 5, wherein said transfer sheaves are rotatably mounted on said carriage and spaced from each other to normally avoid contact with the advancing filament when the filament is being wound on a reel in said winding reference plane, said carriage being mounted for movements to positions to engage the filament in said winding reference plane by one of said transfer sheaves for deflecting the filament to said tangent configuration in relation to an associated reel during transfer of spooling between reels.

7. Spooling apparatus as defined in claim 1, wherein said deflection means comprises a pivotally mounted throw pin having a filament deflecting end which is movable along a circular path which traverses said winding and cutting reference planes and engages the filament when in said tangent orientation for deflecting the filament out of said winding reference plane and into said cutting reference plane.

8. Spooling apparatus as defined in claim 7, wherein said deflecting means includes means for selectively pivoting said throw pin just prior to cutting of the filament by said cutting means.

9. Spooling apparatus as defined in claim 1, wherein said cutting means comprises a stationary cutting element associated with each reel and having a cutting edge disposed proximate to the periphery of an associated reel flange arranged between said winding and cutting reference planes.

10. Spooling apparatus as defined in claim 9, wherein said snagging means is arranged to hold the filament to be cut in a position to engage said cutting edge to thereby cut the filament while continuing to hold the upstream end of the filament.

11. Spooling apparatus as defined in claim 1, wherein the flanges of the reels have diameters approximately twice the diameters of the drums, said control means accelerating the rotation of the empty reel to substantially double the rotational velocity of the empty reel during one revolution of the empty reel from the time when the filament is cut and held by said holding means at said outer radial position of the flange periphery to the time when the filament is first deposited on the empty reel drum at said intermediate radial position.

12. Spooling apparatus as defined in claim 1, wherein said storage means comprises a spiral track defining said elongate path.

13. Spooling apparatus as defined in claim 12, wherein said spiral track has an L-shaped cross section to form a retaining lip for retaining the filament between said retaining lip and the flange of the empty reel during formation of the long end.

14. Spooling apparatus as defined in claim 1, wherein the rim of the flange is configured with a smooth entry surface that leads into said radial slot that guides the filament through said radial slot when the filament is disposed in said cutting reference plane and urged by said positioning means to move to said winding reference plane.

15. Spooling apparatus as defined in claim 1, further comprising shielding means for shielding the downstream end of the cut filament as it rotates with the reel from which continued spooling has terminated.

16. Spooling apparatus as defined in claim 15, wherein said shielding means comprises a cylindrical shield having a diameter substantially corresponding to the diameter of the reel flanges to at least partially receive an associated reel with close tolerance and selectively cover at least the reel flange and a portion of an associated reel barrel proximate to the reel flange and including said winding reference plane, whereby the downstream end of the cut filament only engages said cylindrical shield upon the filament being cut to minimize damage to the outer end of the wound filament on the reel from which transfer of spooling takes place.

17. Spooling apparatus as defined in claim 16, wherein said shielding means further comprises activation means for moving said cylindrical shield from a normal non-shielding position axially spaced from an associated reel along the direction of the axis of the reel and a shielding position only during the period between the time that the filament is cut and the wound reel from which transfer of spooling has taken place comes to a stop.

18. A spooling method of continuously winding of a continuous filament on reels each having a cylindrical drum and circular end flanges at each axial end of the drum, comprising the steps of supporting two spaced reels for rotation about substantially parallel axes and for substantially aligning of set of corresponding flanges of the reels within a region between spaced, substantially parallel winding and cutting reference planes that are substantially normal to said axes; guiding the filament to one of the reels for spooling while the other of the reels is empty, including selectively guiding the filament to said winding reference plane during transfer of spooling to an empty reel and positioning at least a portion of the filament in a direction substantially tangent with the periphery of the flange of the empty reel just prior to changeover of spooling to the empty reel while permitting continued spooling of the filament on the other, wound reel; momentarily deflecting the advancing filament from said winding to said cutting reference planes just prior to snagging and cutting of the filament while maintaining the advancing filament in said substantially tangent direction; cutting the filament in said cutting reference plane at said substantially tangent portion; snagging the filament and moving the filament to said cutting means for cutting and retaining an upstream end of the cut filament substantially at the periphery of the flange of the empty reel at an outer radial position while permitting the downstream end to be wound on the wound reel; storing a long end prior to spooling the empty reel along an elongate generally spiral path arranged in said cutting reference plane which gradually extends from the snagging point at the flange periphery to an intermediate radial position substantially co-extensive with the surface of the empty reel drum, the flange of the empty reel drum being arranged between said winding and cutting reference planes and being provided with a generally radial slot which extends substantially from a point on the periphery of the flange just prior to the point of snagging to said intermediate radial position on said elongate path, whereby a long length is deposited along said elongate path and enters said radial slot to provide a smooth transition of movement of the filament from said elongate path in said cutting reference plane to the drum of the empty reel in said winding reference plane; driving said reels at selected speeds and for initially driving the empty reel at a first speed when the filament is pulled into said cutting reference plane; and accelerating the speed of rotation of the empty reel from said first speed as the filament is initially deposited along said elongate path to a higher, second speed as the filament is removed from said elongate path and applied to the drum of the empty reel at least partially compensate for the variable radial distances from the time that the filament is cut and held at the rim of the empty reel to the time that the filament is initially wound on the drum of the empty reel, and whereby the filament is subjected to minimal bending and tensile stresses during transfer of spooling from one reel to the other.

19. A spooling method as defined in claim 18, further comprising the step of shielding the downstream end of the cut filament as it rotates with the reel from which continued spooling has terminated.

* * * * *